United States Patent [19]

Tillie

[11] 4,015,387

[45] Apr. 5, 1977

[54] PREFABRICATED STRUCTURAL ELEMENTS FOR PARTITIONS AND WALLS OF BUILDINGS AND PARTITIONS AND WALLS CONSISTING OF SUCH ELEMENTS

[75] Inventor: Etienne Lucien Tillie, La Colle sur Loup, France

[73] Assignee: Tramex S.A., Luxembourg, Luxembourg

[22] Filed: Aug. 14, 1974

[21] Appl. No.: 497,325

[30] Foreign Application Priority Data

Aug. 30, 1973 France ..... 73.31439
May 17, 1974 France ..... 74.17311

[52] U.S. Cl. ..... 52/309.17; 52/405; 52/437; 52/605

[51] Int. Cl.[2] ..... E04C 1/00

[58] Field of Search ..... 52/605, 615, 309, 405, 52/437, 612, 270, 271, 293, 436, 144, 506; 106/110, 111

[56] References Cited

UNITED STATES PATENTS

| | | | |
|---|---|---|---|
| 2,114,244 | 4/1938 | Zoettl | 52/605 X |
| 3,247,294 | 4/1966 | Sabouni | 52/612 X |
| 3,435,586 | 4/1969 | Merrill et al. | 52/405 |
| 3,479,779 | 11/1969 | Ziegler | 52/144 |
| 3,678,640 | 7/1972 | Tillie | 52/309 X |
| 3,869,295 | 3/1975 | Bowles et al. | 106/111 X |

FOREIGN PATENTS OR APPLICATIONS

| | | | |
|---|---|---|---|
| 845,703 | 8/1952 | Germany | 52/437 |

*Primary Examiner*—Price C. Faw, Jr.
*Assistant Examiner*—Carl D. Friedman

[57] ABSTRACT

Prefabricated elements juxtaposable for making partitions and walls of buildings, having each one the shape of a parallelepipedic plate comprising a core provided on at least one edge with longitudinal grooves in each one of which open cavities sloping with respect to the edge surface, the grooves and cavities being filled after juxtaposition of the elements with a settable binder injected under pressure, the core consisting of a light-weight, rigid and strong material and being formed on its portions comprising said grooves with means for communication between the grooves, said means being filled with binder upon its injection under pressure into the grooves and cavities.

9 Claims, 5 Drawing Figures

PREFABRICATED STRUCTURAL ELEMENTS FOR PARTITIONS AND WALLS OF BUILDINGS AND PARTITIONS AND WALLS CONSISTING OF SUCH ELEMENTS

The invention relates generally to prefabricated structural elements adapted to be juxtaposed for making or erecting partitions and walls of buildings as well as the walls and partitions consisting of such elements.

Whether they are intended for the construction of residential or appartment buildings and dwelling houses or for professional purposes, of hotels, hospitals, private homes or single family houses, etc., these prefabricated structural elements have now to comply with official regulations defining in particular the least values of coefficients or factors of heat insulation. Moreover, on grounds of cost price, transportation or conveyance, handling and laying, mounting or erection easiness attempts are presently made in this field with a view of provide prefabricated elements which are of very light weight but however rigid and mechanically strong for obvious reasons and which enable not only the construction of light-weight partitions but also that of load-bearing supporting or like carrying walls of buildings.

There are already know prefabricated elements made either from concrete when the elements are to be used for load-bearing walls or from plaster when they are used for making light-weight partitions.

In the former case the concrete elements do not meet the criteria set for heat insulation and sound damping, lightness and easiness of handling and of layer or mounting. When laid it is moreover necessary to cover both of their inner and outer faces with a lining, facing or coating of suitable appearance after having provided them with a heat insulating lining.

In the latter case the plaster elements meet the criteria of heat insulation and sound damping, stiffness and mechanical strength better or worse in direct dependence upon their thicknesses and accordingly their weights: the elements having an adequate thickness are heavy, expensive, difficult to handle and to lay or mount whereas the elements having too small a thickness lack rigidity and mechanical strength and do not comply with the criteria of insulation or with the engineering rules.

There is moreover raised the problem of the joints between juxtaposed light-weight elements when being used. There are already known prefabricated juxtaposable elements the web or core of which generally made from plaster is covered on its main faces with linings or coverings forming smooth facings and is formed on its edges with longitudinal grooves the openings of which are in flush registering relationship with the edge surface. Cavities or pits sloping with respect to the edge surface open into these grooves and are adapted together with said grooves to be filled after juxtaposition of the elements with a settable or hardenable binder injected for instance under pressure. When any two elements are juxtaposed their respective grooves provided in their edges are in confronting registering relation to each other and thus form separate parallel channels in which is injected for instance under pressure the binder which after having hardened or set constitutes a joint having the shape or pattern of a fish-bone and rigidly interconnecting or bonding said elements. As those portions of the edges which are separating two successive grooves are made to contact or engage each other, the rigid interconnection or bonding of the juxtaposed elements is provided by the binder alone filling these channels. The bonding thus obtained proves itself to be inadequate in some cases in particular with elements having to withstand significant transverse stresses or strains thus resulting in the possibility for the joint and the elements to become cracked. On the other hand the cross-sectional passageway area exhibited by the channel is relatively small thereby making difficult the injection of some binders having a relatively pasty or viscous consistency so that the filling of the grooves and cavities may be incomplete thereby still more weakening the junction between elements.

It is therefore apparent that presently no prefabricated light juxtaposable elements are available which would meet all of the aforesaid criteria since the design, manufacture and use of such elements set or give rise to serious problems which are far from having been solved in the present state of the art.

The object of the invention is accordingly to solve these problems and to provide juxtaposable prefabricated elements for making partitions and walls of buildings which will not exhibit any of the drawbacks of the prefabricated elements belonging to the prior art.

Another object of the invention is to provide prefabricated elements which are light in weight, provide sound and heat insulation and however are rigid and mechanically strong.

A further object of the invention is to provide prefabricated elements which may be assembled to each other safely and reliably by means of joints at least as mechanically strong as said elements.

For this purpose the invention provides prefabricated juxtaposable elements for the construction of partitions and walls of buildings, each element having the shape of a substantially parallelepipedic plate comprising a core or web formed at least on one of its edges with longitudinal grooves in each one of which open cavities or pits sloping with respect to the edge surface, these grooves and cavities being adapted to be filled after juxtaposition of the elements with a settable or hardenable binder for instance injected under pressure and said elements being characterized in that said core or web is made from a light-weight, heat-insulating, rigid and strong material and comprises on its portions provided with said grooves communication means between these grooves, these communication means being adapted to be filled with the binder upon its being injected into said grooves and said cavities.

These communication means between the grooves, owing to the fact that they are provided for filling themselves with the binder injected between any two juxtaposed elements, are rigidly interconnecting or bonding the fish-bone-like joints constituted by the grooves and cavities and thereby provide for a much stronger bonding. This result in a better inertia of the assembly and a better resistance to transverse stresses or strains.

According to another characterizing feature of the invention said communication means comprise at least one longitudinal continuous cut or recess provided within the thickness of the core material between two successive grooves and opening into each one of said grooves.

Such a cut or recess offers the advantage to provide a continuous bond throughout the height of the elements.

According to still another characterizing feature of the invention said core consists of a material having substantially the mechanical strength of concrete and lightened by means of a large amount of balls made from expanded or foamed polystyrene or from like substance agglomerated within said material.

Thus juxtaposable prefabricated elements are obtained which may be used for the construction of outer walls of buildings and which exhibit a mechanical strength at least equal to that of prior art prefabricated concrete elements while however being much lighter, more heat and sound insulating while the bonding between these juxtaposed elements is very strong due to the provision of the aforesaid grooves, cavities and cuts or recesses.

According to a further characterizing feature of the invention relating to juxtaposable prefabricated elements for walls of buildings, the core comprises an insulating portion forming one of the major faces of said core and a bearing or supporting portion made for example from concrete and forming at least the other major face of the core, the insulating portion being desirably adapted to be located outside of the building for protecting the bearing portion against thermal shocks.

According to another characterizing feature of the invention this bearing or supporting portion has a substantially U-shaped cross-section.

Therefore when any two elements are juxtaposed in aligned registering relationship and assembled a continuous rigid core is obtained which comprises a thick bearing portion made from a stiff and mechanically strong material and having a substantially T-shaped cross-section at the joint between two elements, this T-like shape being the perfect configuration for prefabricated panels intended for the construction of walls for buildings.

The invention will be better understood and further objects, characterizing features, details and advantages thereof will appear more clearly as the following explanatory description proceeds with reference to the accompanying diagrammatic drawings given by way of non-limiting examples only illustrating several presently preferred specific embodiments and wherein.

Figure 1:
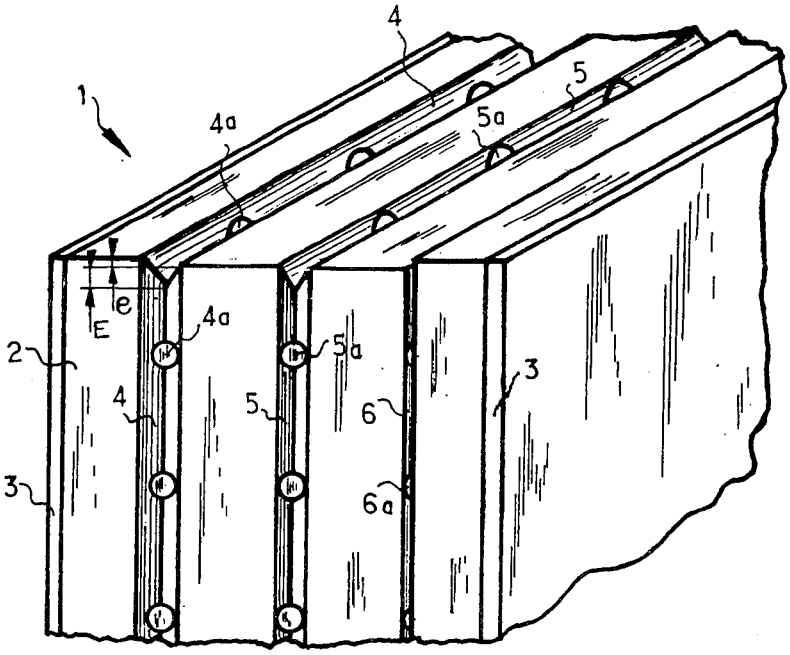
FIG. 1 is a partial perspective view of an element according to the invention.
Figure 2:
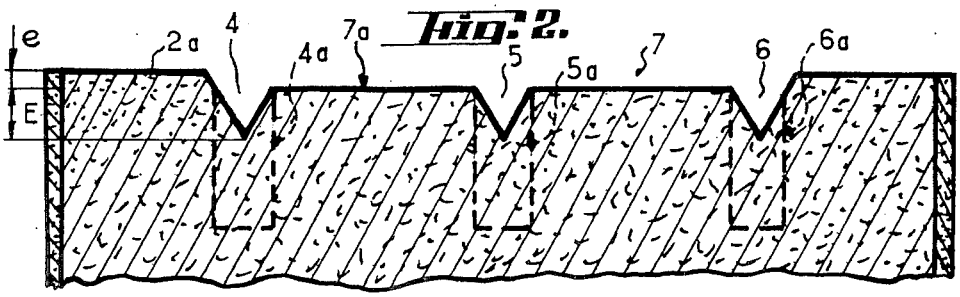
FIG. 2 is a cross-sectional view of said element.

According to the embodiment shown in FIGS. 1 and 2, an element according to the invention generally designated by the reference numeral 1 consists of a core or web 2 made from a rigid, light-weight and strong material such as a mechanically strong material comprising a large amount of balls made from expanded or foamed polystyrene embedded within this material. The structure obtained is thus much lighter and therefore more heat and sound insulating without any decrease in its mechanical strength properties.

As the case may be, the core 2 may be made from an agglomerated compound consisting of cement concrete and expanded polystyrene balls or from a like material or it may be made from an agglomerated unit consisting of $\alpha$ plaster or from a mixture of $\alpha$ and $\beta$ plasters and of expanded polystryene balls or any like material. It is known indeed that there are two varieties of plasters, the one called $\alpha$ and the other called $\beta$, the $\alpha$ plaster having a mechanical strength higher than that of cement and the $\beta$ plaster being much less hard but being of a lower cost price. The $\alpha$ and $\beta$ plasters may be natural or synthetic materials and they are obtained in the latter case through regeneration of phosphate wastes or scraps thereby offering significant openings to the phosphate treating or processing industries.

More conventionally the core 2 may be made from an agglomerated product consisting of plaster reinforced with straw or from a reinforced expanded polystyrene.

In FIGS. 1 and 2 the core 2 is covered on each one of both of its main faces with a lining or coating 3 forming a smooth visible or exposed facing made for instance from compact, polished and sized plaster.

The core 2 comprises on both of its visible edges in FIG. 1 three longitudinal parallel grooves 4, 5 and 6 extending throughout the length of each edge and having a same section of dihedral shape. The core 2 also comprises a plurality of cavities or pits 4a, 5a, 6a opening into each one of the grooves 4, 5 and 6, respectively, these cavities or the like consisting of cylindrical blind holes of substantially circular section the centre lines of which exhibit with respect to the plane of the edge into which they are opening a certain slope, this slope being besides directed in opposite directions from one cavity to the next one.

Each edge of the core 2 comprises moreover in its central portion a longitudinal cut or recess 7 extending throughout the length of the edge and provided over a portion of the thickness of the core material between the grooves 4 and 5 on the one hand and the grooves 5 and 6 on the other hand. The depth $e$ of this cut or recess, i.e. the distance from its bottom to the edge face 2$a$ of the core 2 is in the embodiment shown in FIGS. 1 and 2 substantially equal to the quarter of the depths E of the grooves. It should however be pointed out that this ratio ½ is not at all critical and may vary significantly (as in FIGS. 3 and 4) without however reaching the value 1/1 which would result in the vanishing of the grooves.

The cuts or recesses 7 may be provided either through machining of the edges of the element the grooves and cavities of which are generally formed by moulding or they may be obtained directly by moulding at the same time as these grooves and cavities and then undergo a finishing operation through milling.

Figure 3:
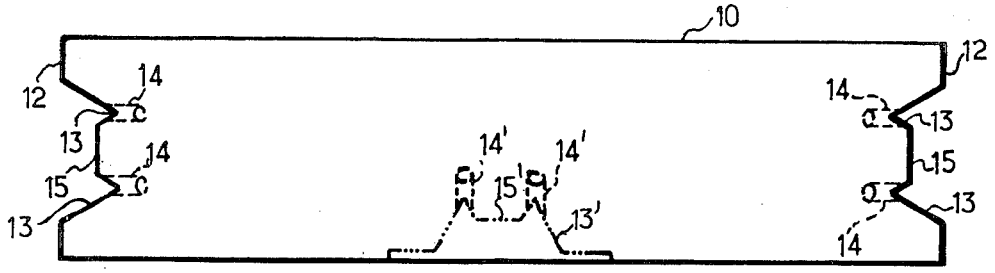
FIGS. 3 and 4 are endwise views of two prefabricated elements according to the invention in particular showing one of the transverse edges of each element.

In the embodiment illustrated in FIG. 3 both edges 12 of the prefabricated element 10 are provided with grooves 13, cavities or pits 14 and cuts or recesses 15 as shown and there may also be provided grooves 13', cavities 14' and cuts or recesses 15' in the inner longitudinal major face of the element 10 for starting a partition when this element is used as a wall element.

Figure 4:
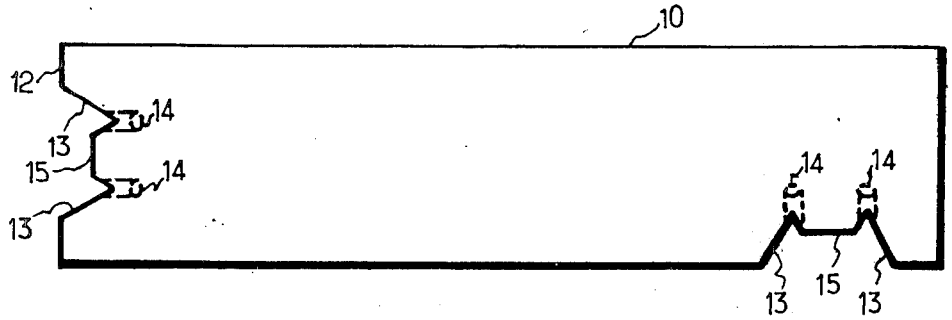

In the alternative embodiment shown in FIG. 4 only one of the edges 12 of the elements 10 is provided with grooves 13, cavities 14 and cuts or recesses 15 whereas the opposite edge remains smooth. The inner longitudinal major face of the element 10 is provided, on the side of this latter edge, with longitudinal grooves 13, cavities 14 and cuts or recesses 15 enabling to secure another prefabricated element at right angles to the element 10 shown when the latter is used at a corner of a building.

Figure 5:
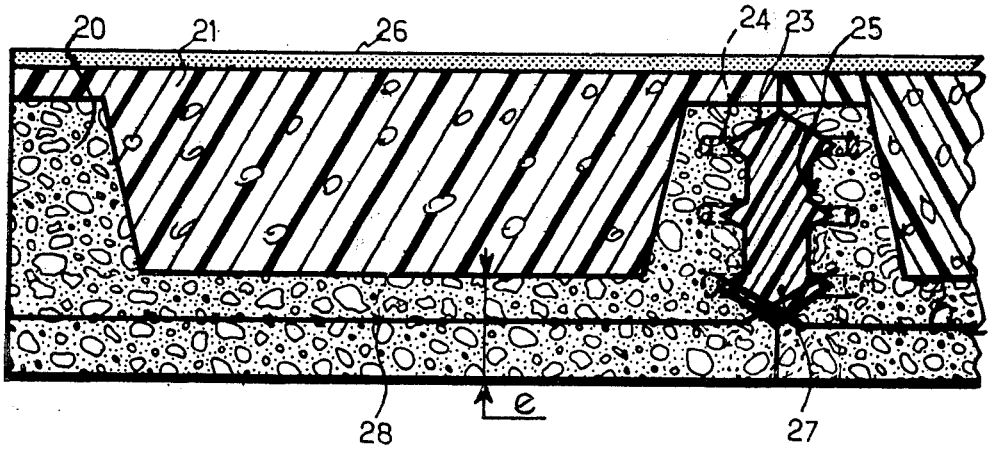
FIG. 5 is a partial cross-sectional view of two elements according to the invention shown in their assembled condition.

Finally in the embodiment shown in FIG. 5, the aformentioned rigid core of the prefabricated element according to the invention consists of an insulating portion 21 forming one of the longitudinal major faces of the core and of a bearing portion 20 forming the other major face of the core and at least one portion of its edges, this bearing portion 20 being made from a rigid and mechanically strong material such as cement concrete possibly including expanded polystyrene balls. The insulating portion 21 of the core which has a substantially trapezoidal shape is an agglomerated product made from $\alpha$ or $\beta$ plaster and from expanded polystyrene balls or like material so that the prefabricated element thus obtained is much lighter than an element of the same shape made throughout from cement concrete.

As in the examples shown in the previous Figures, at least one of the edges of this prefabricated element comprises grooves 23, sloping cavities 24 opening into the bottoms of the grooves 23 and longitudinal cuts or recesses 25 formed between two grooves 23. The longitudinal inner face of the prefabricated element is here provided with a visible or exposed lining or facing 26 consisting for instance of a plaster plate which may be secured or adhesively bonded, stuck or glued into the inner longitudinal face of the prefabricated element or which may be incorporated therein during manufacture thereof. In other forms of embodiment this lining plate 26 may be adhesively bonded to stuck at discrete spots onto the corresponding face of the prefabricated element so as to leave therebetween a free space or void filled with air enhancing the thermal and acoustical insulation.

The prefabricated elements according to the invention are assembled to each other by being juxtaposed so that their corresponding portions provided with grooves 23 and cuts or recesses 25 be positioned in front of and close to each other after a sealing bead has been applied longitudinally over each end rim of the edge of a prefabricated element and after some reinforcement has possibly been inserted into the joint and then a hardenable or settable binder 27 is injected under pressure or cast or poured from above into the channel constituted by the grooves 23 and the cuts or recesses 25 located in front of each other. This settable or hardenable binder may be a special concrete consisting of rather fine aggregates and resins enabling to improve the mechanical characteristics such as mechanical strength and adhesion, grip or bond of the concrete.

When any two prefabricated elements are assembled or joined together as shown in FIG. 5, it should be noted that the bearing portion 20 made from cement concrete and consisting of the associated bearing portions of two adjacent elements has substantially a T-shaped cross-section which is the ideal configuration for the construction of load-bearing or supporting panels used in walls and bulkheads of buildings.

In order to increase the mechanical stength of the assembly a steel mesh or grating 28 may be embedded into the thick concrete lining 20 while extending in substantially parallel relation to the longitudinal outer face of the element and having its edges slightly rising inwards so as to pass into the planes of the joints filled with hardenable or settable binder between two elements. This mesh or grating 28 may be laid by hand or in a continuous operating step during manufacture. Instead of the mesh or grating 28 steel lines embedded through a continuous operating step into the portion 20 of the concrete may be used or also reinforcing plates which are laid by hand onto the concrete cast intended to form the portion 20, these plates being laid so tht their ends overlap or partially cover each other.

The prefabricated elements shown in FIG. 5 which are more particularly intended for the construction of bearing walls of buildings are advantageously laid with their insulation portion 21 directed outwards whereas the concrete bearing portion 20 is directed inwards thus directly providing a protection of the bearing structure from thermal shocks. Owing to the fact that the bearing portion 20 is itself thermally protected by the insulating portion 21, this insulating portion is no longer subjectd to differential stresses due to the expansion and contraction of the bearing portion 20, so that the junction between the portions 20 and 21 remains perfect thereby providing a good tightness or seal. Moreover the outer bearing walls of the buildings being thus thermally insulated by themselves, it is no longer necessary to provide for a heatinsulating thick coating or lining inside the rooms, thereby avoiding to decrease the inner habitable surface area of these rooms. A consequential advantage of the heat insulation of the outer walls constituted by means of elements according to the invention is that the risk of occurrence of vertical and horizontal cracks is significantly reduced owing to the absence of differential thermal stresses. Moreover, the concrete bearing portion insulated from the outside has a larger thermal inertia and plays to some extent the role of a thermal regulator or controller thereby increasing the comfort inside of the building.

It will be readily appreciated on the other hand that the required thickness *e* of the concrete bearing portion 20 depends upon the load carried or sustained by this portion, i.e. for instance upon the level or height or the storey at which it should be located within a building. The thickness *e* of the portion 20 may therefore be gradually reduced according to the arrangement or position in height of the prefabricated element within the building.

It is therefore apparent that the prefabricated elements according to the invention may be made only from $\alpha$ plaster, from a mixture of $\alpha$ and $\beta$ plasters in suitable proportions or also from concrete, all these materials advantageously including an embedded product made from expanded polystyrene balls or from like material enabling to reduce the weight thereof significantly and to increase their coefficient of thermal and acoustical insulation. As shown in FIG. 5 the element according to the invention may also consist of a rigid plaster core including an embedded product made from expanded polystyrene balls and a thick concrete bearing portion. In any case these elements may be provided on at least one of their longitudinal major faces with a visible or exposed lining, coating, covering or facing such as the plaster plate 26 shown in FIG. 5; this visible lining may also consist of any fluid-tight or untight coating. In some particular cases the engaging face of a plate forming a visible or exposed lining on the corresponding face of the refabricated elements may form a steam screen or shield.

It should accordingly be understood that the invention is not at all limited to the forms of embodiment described and shown which have been given by way of examples only. In particular it comprises all the means constituting technical equivalents of the means described as well as their combinations if same are carried out according to its gist and used within the scope of the appended claims.

What is claimed is:

1. A prefabricated core element for the construction of partitions and bearing walls of buildings, said core element having the shape of a substantially parallelepipedic plate having peripheral edges and comprising a composite of a first section formed of a thermal insulation material having the face thereof constituting one face of the core element and a second section having the face thereof constituting the opposed face of the core element and being coextensive throughout the area of said core element with said first section, said second core section being made from a lightweight, rigid and strong loadbearing material having a U-shaped cross section with enlarged parallel peripheral edges having load bearing capacity and occupying the major portion of the thickness of the core element at least along said peripheral edges, said first member filling the interior of said U-shaped second member and extending over the peripheral edges thereof to form an entire face, said second core section having on at least one of the edges thereof a plurality of longitudinal grooves and a plurality of blind bores formed in said grooves extending into said core at an angle with respect to the edge surface, said grooves and blind bores being adapted to be filled after juxtaposition with a like prefabricated element with a settable binder injected therebetween.

2. A prefabricated element according to claim 1, including reinforcing means embedded into said second core section.

3. A prefabricated element according to claim 1, wherein said rigid second section consists of plaster having a plurality of expanded polystyrene balls embedded therein.

4. A prefabricated element according to claim 1, wherein said rigid second section consists of cement having a plurality of expanded polystyrene balls embedded therein.

5. A prefabricated element according to claim 1, wherein said first core section is made from plaster having a plurality of expanded polystyrene balls therein and the load-bearing section is made from concrete having a plurality of expanded polystyrene balls therein.

6. The prefabricated core element according to claim wherein said peripheral edges provided with said grooves each including a recess extending the length of said edges and extending over a portion of the thickness of said edges between at least two consecutive grooves thereby providing communication between said grooves and said blind bores, said recesses thus being adapted to be filled with said binder when the latter is injected into said grooves and blind bores.

7. A prefabricated element according to claim 6, including at least three of said grooves, said recesses between any two successive grooves have the same depth.

8. A prefabricated element according to claim 6, wherein each recess has a depth substantially equal to one quarter that of said grooves.

9. A prefabricated element according to claim 6 wherein said core is coated with a visible lining material.

* * * * *